United States Patent [19]

Morriss

[11] 4,187,528

[45] Feb. 5, 1980

[54] POWER CONTROL UNIT

[75] Inventor: James W. Morriss, Roanoke, Tex.

[73] Assignee: Hunt Electronics, Inc., Dallas, Tex.

[21] Appl. No.: 812,416

[22] Filed: Jul. 1, 1977

[51] Int. Cl.[2] ..... H05R 1/04

[52] U.S. Cl. ..... 361/399

[58] Field of Search ..... 361/415, 399, 346, 358, 361/395, 390; 338/315, 228, 197, 199; 220/80, 4 F, 4 R; 174/52 R, 66, 67; 312/7 R

[56] References Cited

U.S. PATENT DOCUMENTS

| | | | |
|---|---|---|---|
| 3,159,436 | 12/1964 | Davis | 312/7 R |
| 3,266,656 | 8/1966 | Kridle | 220/80 |
| 3,271,627 | 9/1966 | McDougal | 361/408 |
| 3,479,568 | 11/1969 | Shapiro et al. | 361/415 |
| 3,482,147 | 12/1969 | Kersten | 361/390 |
| 3,531,076 | 9/1970 | Bang | 338/197 |
| 3,831,063 | 8/1974 | Keough | 361/412 |
| 3,913,997 | 10/1975 | Pull et al. | 361/390 |

FOREIGN PATENT DOCUMENTS

| | | | |
|---|---|---|---|
| 2041805 | 2/1972 | Fed. Rep. of Germany | 361/415 |

*Primary Examiner*—David Smith, Jr.

*Attorney, Agent, or Firm*—Hubbard, Thurman, Turner, Tucker & Glaser

[57] ABSTRACT

A unit is disclosed for individually controlling power to multiple loads, such as lights. The unit has multiple phase control channels, each having thyristor control of current to the load, triggered by a ramp-and-pedestal firing circuit employing a unijunction transistor with a capacitor at its emitter. The system has a circuit providing a pulse to all of the firing circuits to discharge the capacitor synchronous with the AC line. Another circuit generates a sinusoidal compensating signal for all of the firing circuits.

Each of the load channels has its own power control. In addition, a master control allows the power on all channels to be changed together, with the proportion of power in each channel set by its individual control.

The unit is housed in a box having a base sheet shaped to form front, bottom and rear walls, with side walls attached at opposite edges of the base sheet. A cover sheet forming the top wall of the box holds the controls of the unit, which are connected to a circuit board mounted to the underside of the cover sheet. Special mounting pieces allow attachment of the cover sheet to the base sheet. Without changing the structure, the cover sheet may be installed in either of two orientations to permit table top or wall mounted use of the unit.

3 Claims, 17 Drawing Figures

FIG. 1
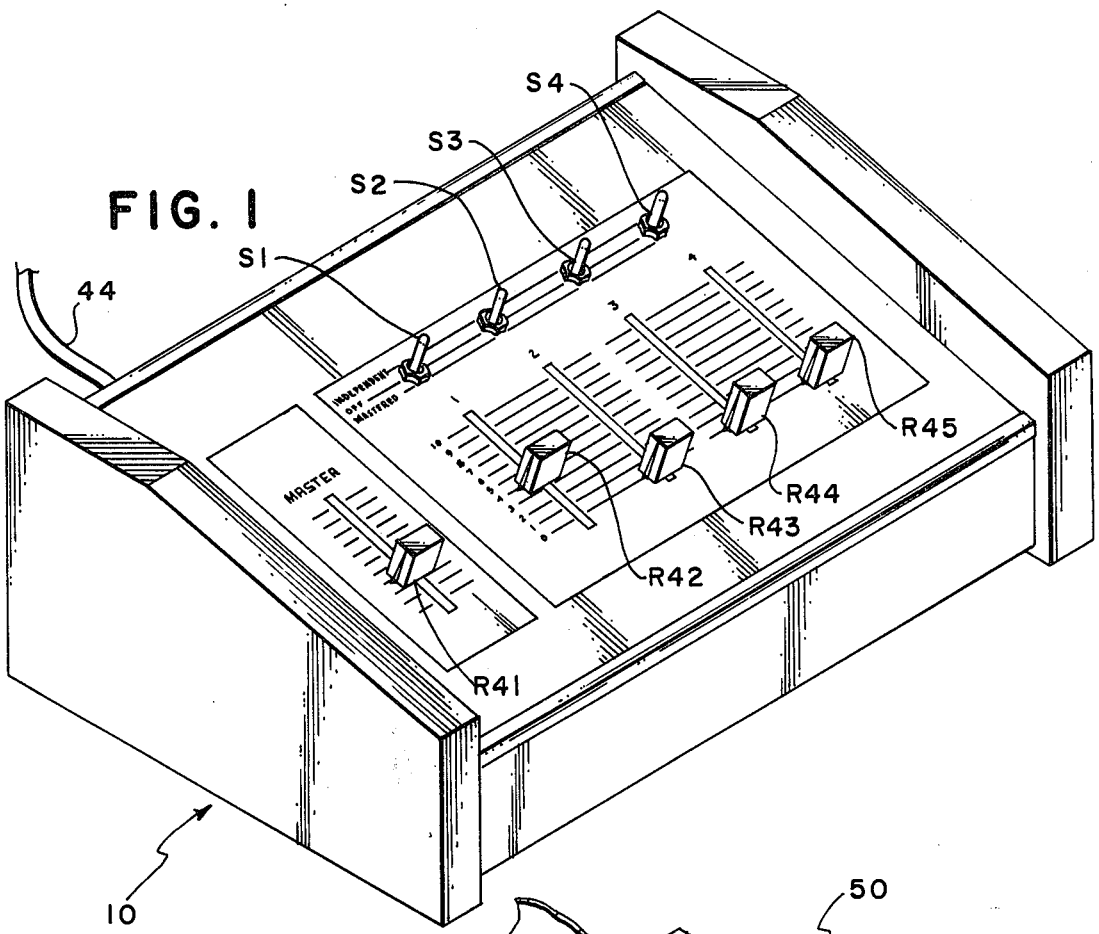
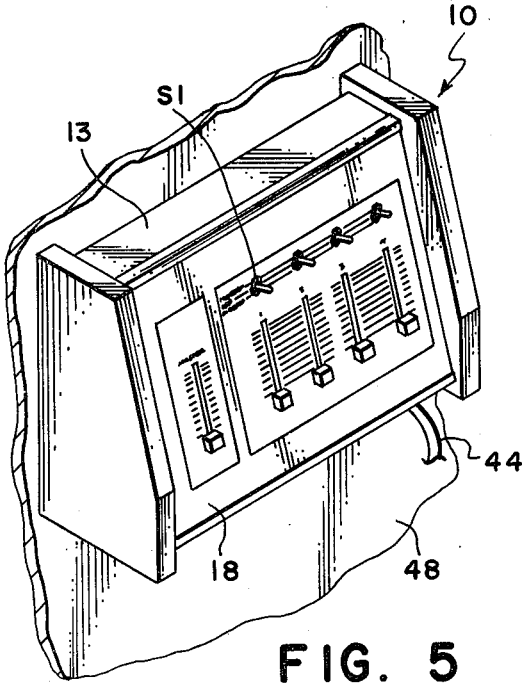
FIG. 5
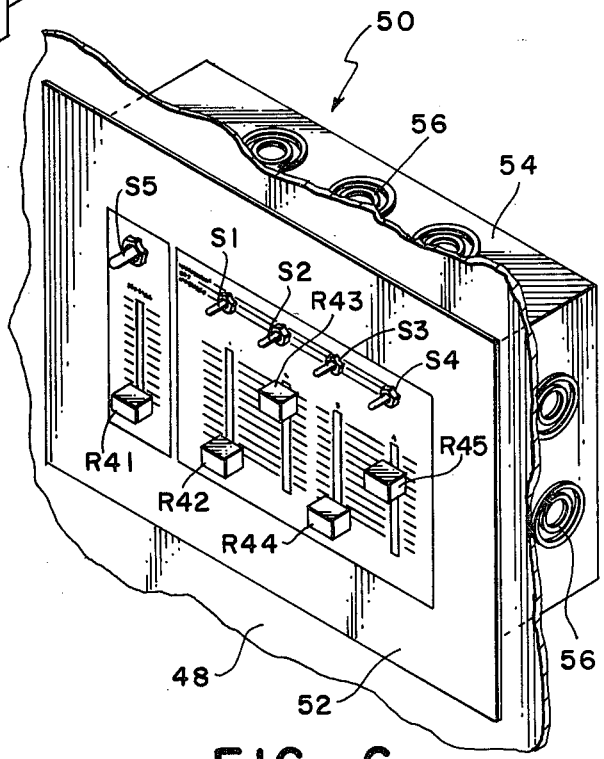
FIG. 6

FULL WAVE
RECTIFIED WAVEFORM

INVERTED COMPENSATING
WAVEFORM

SYCHRONIZING PULSE

CAPACITOR VOLTAGE
MIN. POWER SETTING

CAPACITOR VOLTAGE
MED. POWER SETTING

CAPACITOR VOLTAGE
MAX. POWER SETTING

POWER CONTROL UNIT

BACKGROUND OF THE INVENTION

This invention relates to a power control unit and, more particularly, to a system suitable for multiple channel light control.

There are lighting environments in which it is desirable to have control over the brightness of individual lights or groups of lights. Such control is used for example in theaters, auditoriums, churches and so forth. Accordingly, it is useful to have a control unit in which each control can vary the power to a light or set of lights. An additional useful capability is a master control which can dim or raise the brightness of all the lights simultaneously, as at the beginning and end of acts in a theatrical performance. The present invention provides a power control suited for such installations.

SUMMARY OF THE INVENTION

In accordance with the present invention, there is provided a control system for controlling the connection of an alternating current source to multiple loads. The system includes means responsive to the alternating current source for generating a sinusoidal compensating signal and means also responsive to the alternating current source for generating a synchronizing pulse at the time when the alternating current is zero. There are multiple load channels, each one being associated with a different one of the loads. Each channel includes a capacitor and means for charging the capacitor toward a potential selected for the one channel. In addition the channel includes means responsive to the compensating signal for charging the capacitor with a current that varies as the absolute value of the alternating current. Each channel additionally includes means for connecting the alternating current source to the load associated with the one channel when the voltage on the capacitor reaches a firing potential. Each channel also has means responsive to the synchronizing pulse to discharge the capacitor.

In another aspect of the invention, each channel has means for controlling the phase at which current is connected to the load associated with the one channel. In addition, there is a master control for controlling said phase for all channels simultaneously.

A control unit enclosure according to the invention, has a base sheet shaped to form front, bottom and rear walls, with side walls attached at opposite ends of the base sheet. A cover sheet forming the top wall of the box holds the controls of the unit, which are connected to a circuit board mounted to the underside of the cover sheet. Special mounting pieces allow attachment of the cover sheet to the base sheet.

In a preferred embodiment, without changing the structure of the enclosure, the cover sheet may be installed in either of two orientations to permit tabletop or wall mounted use of the unit.

The present invention provides a versatile, self-contained light control unit. It has features which allow it to be adapted to either horizontal tabletop use or vertical wall mounted use. The particular structure, including special brackets for holding the cover sheet, permits good access to the interior of the unit for maintenance.

There are, in addition, advantageous features of the electrical system. The relationship of the master control and channel controls permits simultaneously changing all brightness levels, while preserving the comparative brightnesses of the individual lights or sets of lights. Whereas certain circuit elements are necessary for each control channel, it has been possible with one means to generate a sinusoidal compensating signal for all channels. In addition, it has been possible to employ one means to generate a synchronizing pulse for all channels. The elimination of the compensating and synchronizing functions from each channel result in a more economical unit.

These and other features and advantages will become apparent from a consideration of the description of the preferred embodiment which follows.

BRIEF DESCRIPTION OF THE DRAWING

FIG. 1 is a perspective view of a control unit according to the invention.

FIG. 5 is a perspective view of the unit of FIG. 1 mounted on a wall.

FIG. 6 is a perspective view of a flush mounted embodiment of a control unit according to the invention.

Figure 2:
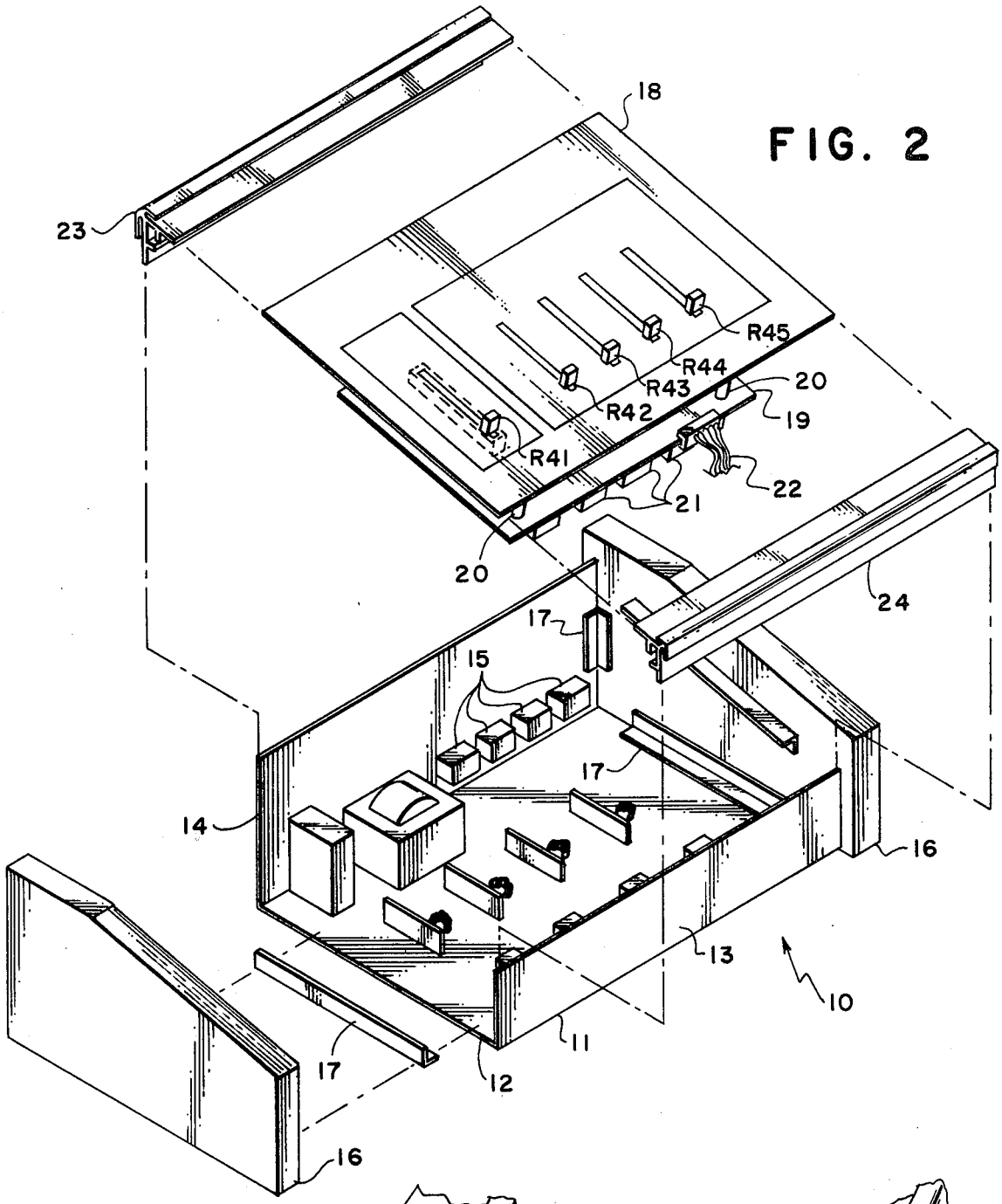
FIG. 2 is an exploded view of the unit of FIG. 1.

FIGS. *9a–9h* is an illustration of waveforms generated in the operation of the electrical system according to the invention.

DESCRIPTION OF THE PREFERRED EMBODIMENT

FIG. 1 shows a control unit according to the invention, indicated generally by the reference numeral 10. Controls which can be seen in FIG. 1 include a power on/off switch S5 and a master power control R41, which is a slide potentiometer. The unit has four power control channels, each of which has associated with it one of switches S1–S4 and one of slide potentiometers R42–R45. For example, Channel 1 is controlled by switch S1 and potentiometer R42. The switches each have three positions, INDEPENDENT, OFF and MASTERED, as shown in the drawing. The potentiometers slide against a numbered scale. The master and channel controls are used to adjust power flowing to four different loads, as described in detail below.

FIG. 2 shows the construction of the unit 10. A sheet 11 of metal is bent to form a base which has the bottom 12, front wall 13 and rear wall 14 of the control unit box. The rear wall 14 is of a greater height than the front wall 13. There is a group of electrical components which are mounted on the inside of the base sheet 11, including four power receptacles 15 which project through the rear wall 14 to connect with the loads for which unit 10 controls power.

Wooden side walls 16 fit against opposite edges of the base sheet. Brackets 17 are used to connect the sidewalls 16 to the bottom, front and rear walls, preferably with screws.

The top of the control unit box is formed by a cover sheet 18 of metal which has the controls including slide potentiometers R41–R45 on it. A circuit board 19 is mounted with standoffs 20 on the underside of cover sheet 18. A group of electrical components 21 on board 19 is connected to the controls on the cover sheet 18. An electrical cable 22, shown broken away, connects the group of components 21 with the components on the base sheet.

Figure 3:
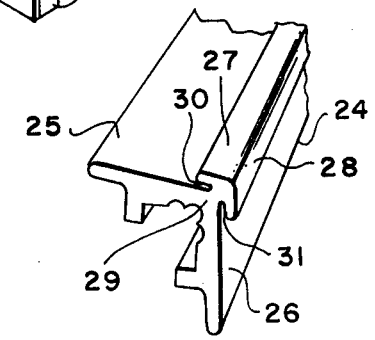
FIG. 3 is a detail of a mounting piece shown in FIG. 2.
Figure 4:
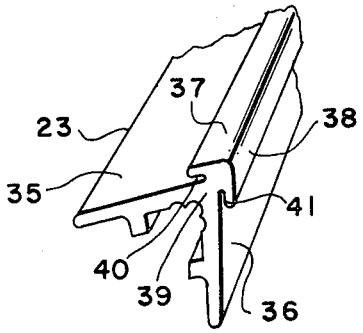
FIG. 4 is a detail of another mounting piece shown in FIG. 2.

Mounting pieces 23 and 24, used to attach cover sheet 18 to the bottom sheet 12, are shown in greater detail in FIGS. 3 and 4. These pieces can be made by extrusion. In piece 24 (FIG. 3), a first planar element 25 projects from the edge 29 of the piece at an angle so that the element 25 will lie against and beneath the cover sheet 18. A second planar element 26 projects from edge 29 so as to lie against the inside of front wall 13. A third planar element 27 is parallel to element 25 and spaced above it, so that it projects on top of the cover sheet 18. Similarly, a fourth planar element 28 lies against the outside of front wall 13. The elements 25 and 27 form a notch 30 into which the front edge of sheet 18 fits. Likewise, elements 26 and 28 form a notch 31 into which the top edge of front wall 13 fits.

Mounting piece 24 in FIG. 4 has four planar elements 35–38 comparable to elements 25–28 of mounting piece 24. Elements 35 and 37 form notch 40; elements 36 and 38 form notch 41. In piece 23, the angle between planar elements 35 and 36 is acute to match the desired angle between cover sheet 18 and rear wall 14.

In the attachment of the cover sheet 18, the front edge thereof is inserted in notch 30, while the rear edge is inserted in notch 40. Then the cover sheet with mounting pieces 23 and 24 is lowered so that the top edges of front wall 13 and rear wall 14 are inserted in notches 31 and 41, respectively. Screws are then used to attach element 26 to front wall 13 and element 36 to rear wall 14.

FIG. 5 shows how control unit 10 can be used vertically mounted, as on a wall 48. It can be seen in FIG. 5 that in this case the switches S1–S4 are near front wall 13 of unit 10 rather than the rear wall 14 as in FIG. 1. In a table top configuration such as that in FIG. 1, it is generally desirable to have the power receptacles 15 (FIG. 2 only) and AC power cord 44 leading away from the user. However, in the wall mounted arrangement of FIG. 5, it is generally desirable to have the receptacles 15 and power cord 44 extending downward. In addition, it is desirable to have the cover sheet 18 of unit 10 slope upward away from the user, for readability. Since the receptacles 15 and power cord 44 are mounted in the rear wall 14 of unit 10, it is effective to reverse the installation of the cover sheet 18, putting the switches S1–S4 toward front wall 13. To make this possible, cable 22 (FIG. 2) must be made long enough so that cover sheet 18 may be installed either way. It is an advantage of the construction of unit 10 that the cover sheet and circuit board 19 are so easily installed in alternate orientations.

FIG. 6 shows a flush mount embodiment of a control unit according to the invention, indicated generally by the reference numeral 50. In unit 50, the controls are the same as those of unit 10 in FIG. 1, except that a power on/off switch S5 is additionally provided. A cover sheet 52, somewhat larger than sheet 18 of unit 10 is mounted against the wall 48. The remainder of the enclosure for unit 50 can be a five-sided electrical junction or switching box 54. The box 54 has knockouts 56 for power conductors in and out of the box.

Figure 7:
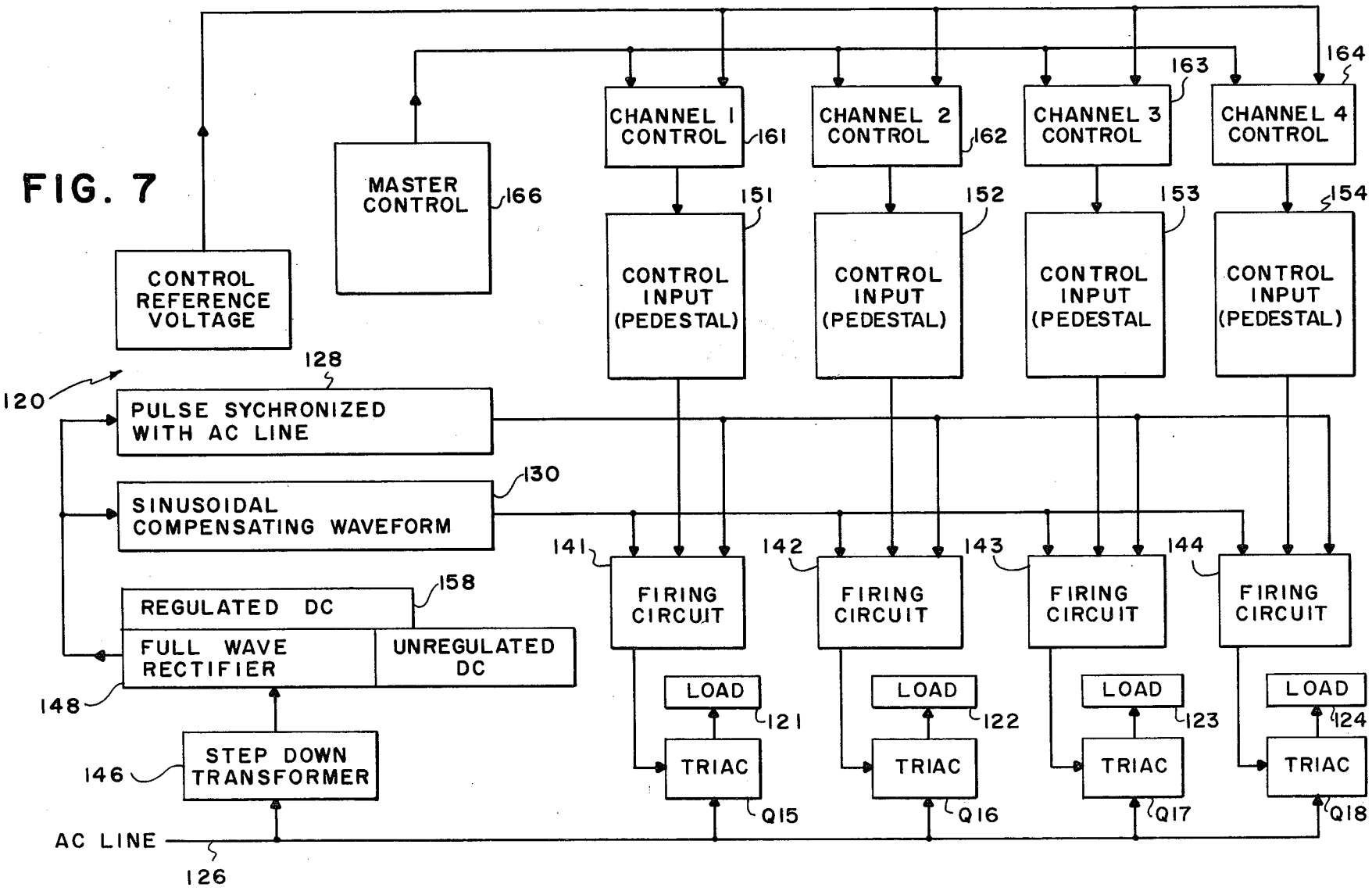
FIG. 7 is a block diagram of the electrical system of a control unit according to the invention.
Figure 8A:
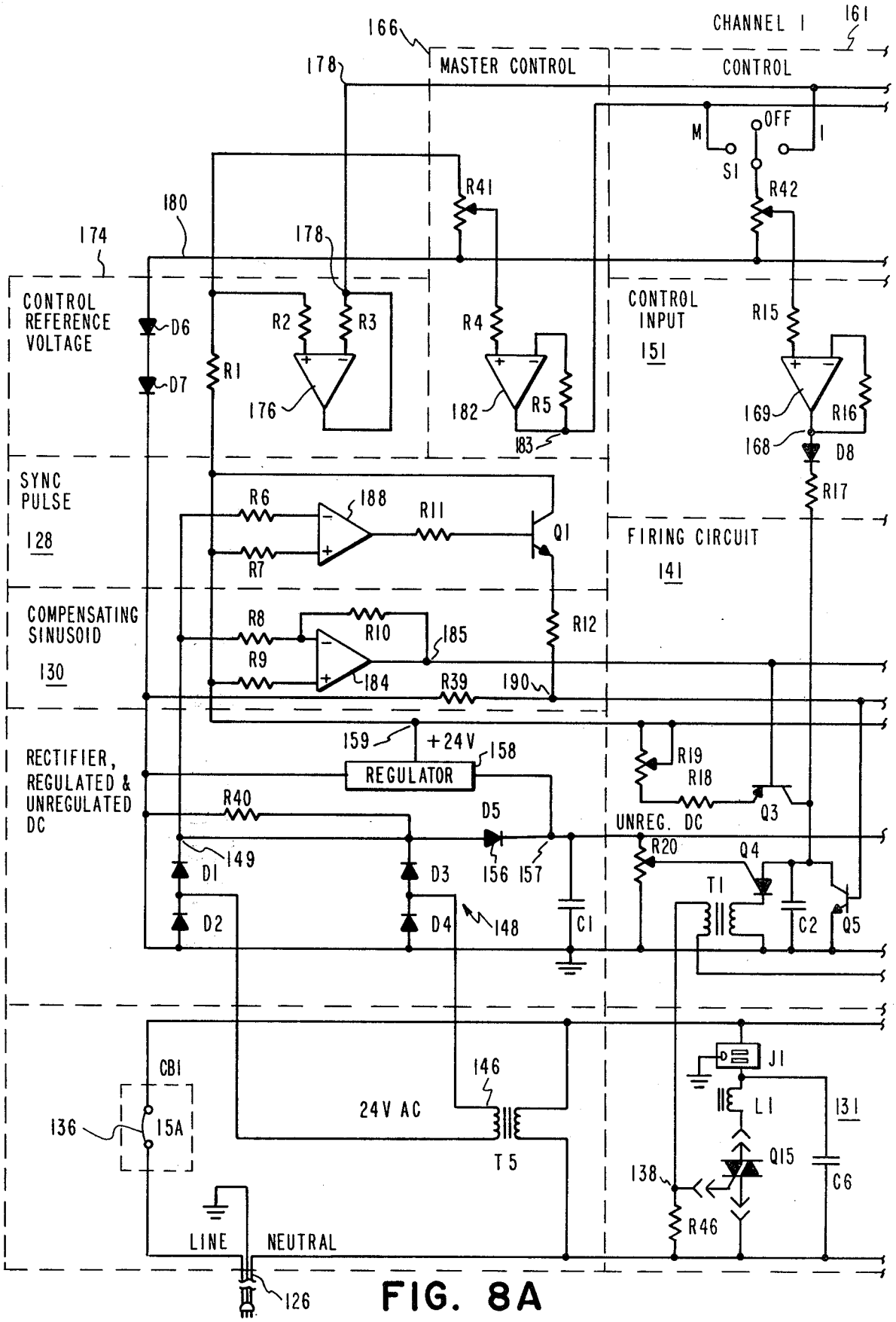
FIGS. 8A–8B is a schematic diagram of the system of FIG. 7.
Figure 8B:
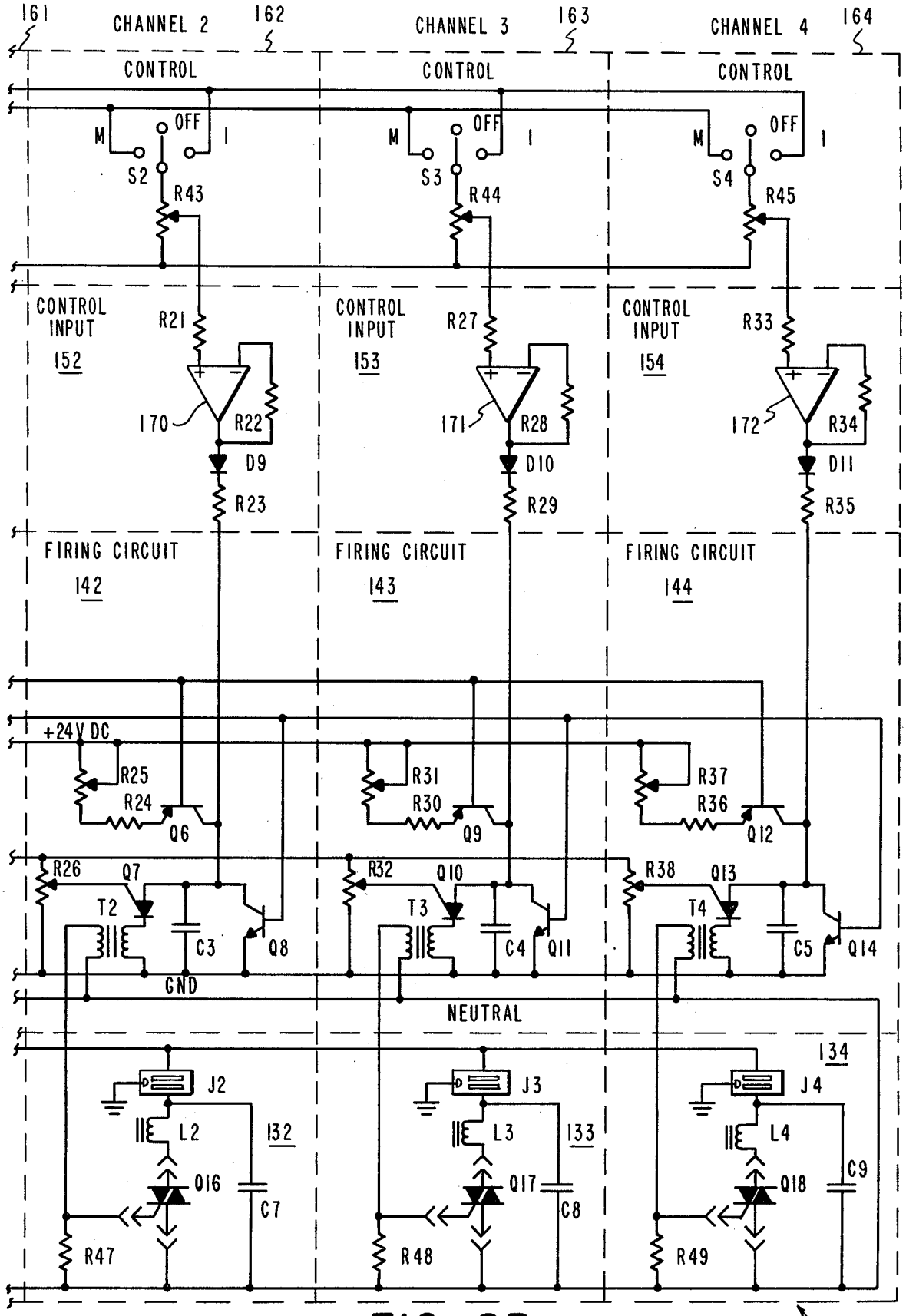

The electrical circuit of the control system of the invention is illustrated by the block diagram in FIG. 7 and the detailed schematic diagram in FIG. 8. The blocks in FIG. 7 have been made to correspond closely, even as to position on the page, to subdivisions of the circuit in FIG. 8 enclosed by broken lines. The electrical system is indicated generally by the reference numeral 120.

As can be seen in FIG. 7, the electrical system of the invention has four channels, each controlling power to one of the loads 121–124. The loads are preferably resistive loads, for example, light bulbs. It will become apparent from the description that follows that the system 120 can be designed with any number of control channels.

Figure 9A:
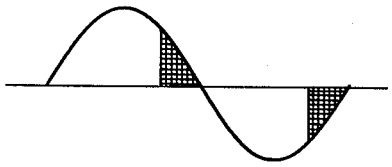
Figure 9B:
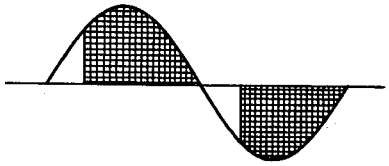
Figure 9C:
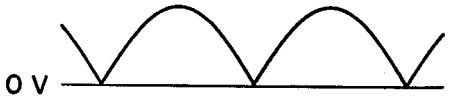
Figure 9D:
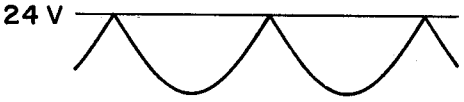
Figure 9E:
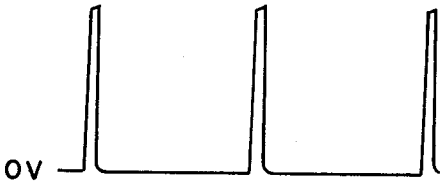
Figure 9F:
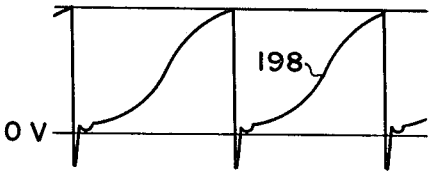
Figure 9G:
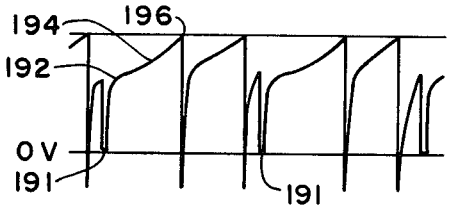
Figure 9H:
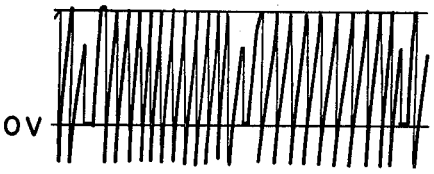

The "phase control" executed by each channel of the system 120 is illustrated with reference to FIGS. 9*a* and 9*b*. In those drawings are shown two alternating current wave forms which can be applied to a load. The hatched portion in each waveform represents an interval during which the alternating current is actually connected to the load by the system 120; during other parts of the cycle, the current is disconnected from the load. In FIG. 9*b*, current is connected to the load at an earlier time in the cycle; therefore, the load receives more power. Thus, a light bulb being energized according to the phase relation in FIG. 9*b* would, in general, be brighter than one corresponding to FIG. 9*a*.

In the system 120, current from the AC line 126 is switched to each of the loads 121–124 by one of triacs Q15–Q18. The triacs are, in turn, controlled by firing circuits 141–144. The firing circuits are of the ramp-and-pedestal type, in which the timing of the firing is controlled by a selectable voltage level. These voltage levels are supplied to the firing circuits by input circuits 151–154 and channel controls 161–164, in conjunction with master control 166.

Each of the firing circuits 141–144 must have its timing synchronized with the AC line 126. Circuit 128 provides a synchronizing pulse for this purpose to each of the firing circuits 141–144. The circuit 130 provides a particular sinusoidal waveform to each of firing circuits to produce a desirable compensating effect.

With reference to FIG. 8, it can be seen that there is connected across the AC line a circuit 131, including a series combination of triac Q15 and receptacle J1, which in use has the load 121 connected thereto. The circuit 131 also has an L section EMI filter made up of inductor L1 and capacitor C6. Identical circuits 132–134 containing triacs Q16–Q18 and receptacles J2–J4 are all connected in parallel with circuit 131. Examining circuit 131, it can be seen that when triac Q15 is nonconducting, the load at receptacle J1 is disconnected from the AC line. Only when a proper trigger pulse is applied to terminal 138, the gate of triac Q15, does the load at receptacle J1 become connected to the line. Thus, it is the object of the control circuitry in system 120 to apply properly timed trigger pulses to the gates of triacs Q15–Q18 to provide power to the receptacles J1–J4 at the selected phasing.

Also connected across the AC line 126, through a circuit breaker 136, is a stepdown transformer T5. The voltage at the secondary 146 of transformer T5 can be, for example, 24 volts peak. This voltage from the secondary 146 is connected to a full wave rectifier 148 comprised of diodes D1–D4, which produces a 24 volt peak full wave rectified potential between terminal 149 and ground. A combination of a diode 156 and a filtering capacitor C1 connected to terminal 149 derives therefrom an unregulated DC potential at the cathode of 156. Regulator circuit 158 produces at its output 159 a regulated 24 volt DC reference potential, derived from the unregulated potential at terminal 157.

The function of the channel controls 161–164, and the circuitry immediately associated with it, is to allow the selection for each channel of a potential that charges a capacitor in the firing circuit for that channel. Thus for example, in Channel 1, a potential at the output 168 of operational amplifier 169 charges capacitor C2 of firing circuit 141. By varying the potential at output 168, the user selects the point in the alternating current cycle, when triac Q15 switches current to the load at receptacle J1.

Circuit 174 provides a DC reference potential for the master control and channel controls. The 24 volt DC reference potential is divided across resistors R1 and R41 to obtain an input to operational amplifier 176. The divided voltage is applied through resistor R2 to the positive input of amplifier 176, which has resistor R3 connected to feedback from the output 178 of the amplifier to the negative input thereof. This configuration serves as a buffer, producing at output 178 a voltage established between resistors R1 and R41. This voltage at output 178 then becomes the control reference voltage applied to the "INDEPENDENT" or "I" terminals of switches S1–S4. The lower reference potential used in the master control 166 and channel controls 161–164 on lead 180, is approximately one volt. This is the sum of the voltages across the diodes D6 and D7 connected in series between lead 180 and ground. The one volt value is used as a lower reference, because the single supply operational amplifiers preferably employed for amplifiers 168–172, 176 and 182 cannot accept inputs going all the way down to ground potential.

The potential applied to the "MASTER" or "M" terminals of switches S1–S4 is set by the use of master control potentiometer R41, which is connected in series with resistor R1 to the 24 volt DC reference potential. The voltage from the wiper of potentiometer R41 is applied through resistor R4 to the positive input of operational amplifier 182, which has resistor R5 connected to feedback from the output 183 of the amplifier to the negative input thereof. The potential derived by potentiometer R41 and buffered by the amplifier 182 configuration is connected from output 183 of the amplifier to each of the "M" inputs of switches S1–S4.

If one of the switches, for example switch S1, is set to the "MASTER" position, then the voltage selected by the master control potentiometer R41 is applied to the potentiometer R42 connected to S1. The fraction of this master potential that is to be applied to the firing circuit of Channel 1, is selected by the setting of potentiometer R42. Thus, for example, when the system 120 is used to control lights, the master setting of switches S1–S4 provides a way to dim or brighten all the lights in Channels 1–4 without disturbing the relative brightness settings between them, selected by potentiometers R42–45.

In the "INDEPENDENT" setting of switches S1–S4, the voltage selected by potentiometers 142–145 is a fraction of the fixed reference potential at point 178. In the "OFF" setting of switches S1–S4 the one volt lower reference potential is applied to the associated one of the control input circuits 151–154.

The potentials from the wipers of potentiometers R42–R45 are applied to buffer amplifier 169–172, respectively. The positive input to operational amplifier 169, for example, is applied through resistor R15. A feedback resistor R16 is connected between the negative input of the amplifier and the output 168 thereof, which is at the same voltage as the wiper of potentiometer R42.

Operational amplifier 184 has connected to the negative input thereof, through resistor R8, the full wave rectifier 148 output, shown in FIG. *9c*. The 24 volt DC reference potential is applied through resistor R9 to the positive input of the amplifier. Amplifier 184 has a feedback resistor R10 connected between the output 185 and the negative input thereof. The effect of this operational amplifier configuration is to produce, at its output 185, a subtraction of the waveform in FIG. *9c* from 24 volts. The result, shown in FIG. *9d*, thus has peaks at 24 volts.

The voltage at the amplifier output 185 is applied to the bases of transistors Q3, Q6, Q9 and Q12. The emitter of, for example transistor Q3, is connected through resistors R18 and R19 to the 24 volt DC supply. Accordingly when the waveform in FIG. *9d* is at its peak of 24 volts, there is no base-emitter drive on transistor Q3. As the base voltage decreases in a sinusoidal fashion, transistor Q3 draws a current which is proportional to the difference between 24 volts DC and the emitter voltage. Since the emitter voltage will be similar to that of the base, shown in FIG. *9d*, the current through transistor Q3 has the waveform of FIG. *9c*. As will be discussed more below, this current is drawn from capacitor C2.

The synchronizing circuit 128 also uses as inputs the 24 volt DC level and the output of the full wave rectifier 148, in this case to generate a synchronizing pulse. The full wave rectified voltage is coupled to the negative input of operational amplifier 188 through R6, which is much smaller than R7 through which the 24 volts DC is connected to the positive input. Thus, the output of amplifier 188 tends to be held negative most of the time. When the full wave rectified signal of FIG. *9c* approaches its minimum, the positive input to amplifier 188 becomes predominant and drives the output of the amplifier positive for a brief period.

The output of amplifier 188 is connected through resistor R11 to the base of transistor Q1, which has the emitter thereof connected through resistors R12 and R39 to ground. So long as the output of amplifier 188 is negative, transistor Q1 is off and the voltage at lead 190 between its emitter resistors is zero. When the output of operational amplifier 188 goes positive, transistor Q1 is turned on and, for a brief period, the voltage at lead 190 is high, as shown in FIG. *9e*. Thus, there are generated synchronizing pulses on lead 190 which occur at the minimum of the full wave rectified waveform and the zero crossings of the alternating current waveform.

The operation of the firing circuits, of which circuit 141 is descriptive, is a matter of timing the firing of unijunction transistors such as transistor Q4. An interbase voltage is established for Q4 by its connection through potentiometer R20 to the unregulated DC supply lead 157. Capacitor C2, connected to the emitter of unijunction transistor Q4, is charged and discharged by various means. When the potential on capacitor C2 reaches a certain fraction of the interbase voltage of transistor Q4, the transistor fires. When it fires, a pulse is coupled through transformer T1, connected to a base of transistor Q4, to gate terminal 138, triggering triac Q15.

The capacitor C2 begins each half of the alternating current cycle in the discharged condition. Thus, in FIG. *9g*, the voltage on capacitor C2 is seen to be driven to zero at times 191. This is because the synchronizing pulse on line 190 is applied to the base of transistor Q5, turning it on and discharging C2. Then, capacitor C2 is rapidly charged, through diode D8 and R17 to a "pedestal" voltage, which is the potential at the output 168 of operational amplifier 169. In FIG. *9g*, the "pedestal" can be seen at point 192. It will be recalled that this voltage is selected by the use of the control circuits 161 and 178.

Capacitor C2 is charged at a much slower rate by the current from transistor Q3, forming the "ramp" 194 in FIG. *9g*. At point 196 on the waveform of that drawing, the voltage on capacitor C2 has increased sufficiently to fire the unijunction transistor Q4. From an examination of FIG. *9g*, it can be understood that if the pedestal 192 were adjusted higher, then the transistor Q4 would fire earlier, turning on current to the load at receptacle J1 earlier in the alternating current cycle. FIG. *9f* shows how long the firing is delayed, when the pedestal voltage is zero. FIG. *9h* shows the use of a high pedestal voltage, which switches power to the load very early in the alternating current cycle.

In both of FIGS. *9g* and *9h*, it can be seen that capacitor C2 is discharged by the firing of the unijunction transistor Q4, then capacitor C2 again charges to the firing point. Subsequent firing of unijunction transistor Q4 does not affect the operation of the triac, which remains on after the first triggering, until the line voltage passes through zero.

The current from transistor Q3 charging capacitor C2 has the waveform of FIG. *9c*. This is for the purpose of giving the ramp voltage the shape seen in FIG. *9f*, with a steeper slope during that portion 198 of the cycle when the AC line voltage is at its peak. When firing is being controlled by portion 198 of the ramp, a given increment in the pedestal voltage produces a smaller change in the phase of firing than it would, say, near the zero crossing of the alternating current waveform. This then compensates for the fact that a given increment in the phase of firing near the line voltage peak results in a greater change in the power delivered to the load than the same phase increment would if made near the zero crossing of the line voltage.

Another form of compensation results from the use of the unregulated DC potential at potentiometer R20 to bias unijunction transistor Q4. If the line voltage fluctuates upward, then switching it to the load at the same phase, results in greater power to the load. However, if the line voltage increased, the unregulated DC potential biasing unijunction transistor Q4 would also increase. Thus, the voltage on capacitor C2 would take a little longer to reach the firing level, thereby compensating for the increased line voltage.

In the use of the system 120, the individual channel controls 161–164 are adjusted to control the power to their respective loads 121–124. When the switches S1–S4 are in the "MASTER" position, master control 166 can be used to raise and lower the power to all loads 121–124 simultaneously.

Relating the block diagram of FIG. 7 to the construction of the control unit 10 in FIG. 2, channel controls 161–164 and part of master control 166 are on the control panel of cover sheet 18. Transformer 146, and triacs Q15–Q18 are mounted on the bottom of base sheet 12. The other circuits are on circuit board 119, including firing circuits 141–144, synchronizing circuit 128 and compensating circuit 130.

Each of the channels includes a firing circuit, circuitry for selecting a pedestal voltage supplied to the firing circuit, and a triac to switch current to the load. However some functions which are common to all channels are performed by only one circuit for all the channels. Thus, the system 120 of the present invention is able to provide a pulse synchronized with the AC line to all channels, using only the circuit 128. Likewise, a sinusoidal waveform for charging the firing circuit capacitors C2–C5 in a compensating fashion is produced for all channels, using the circuit 130. In this fashion, there is avoided the redundancy of requiring these functions for each channel, resulting in a lower cost.

Although preferred embodiments of the invention have been described in detail, it is to be understood that various changes, substitutions and alterations can be made therein, without departing from the spirit and scope of the invention as defined by the appended claims.

I claim:

1. A control unit enclosure, comprising:

a base sheet shaped to form front, bottom and rear walls of the enclosure, said rear wall having a greater height than the front wall;

a pair of side walls against opposite edges of said sheet, thereby in contact with opposite edges of said front, bottom and rear walls;

means for connecting each of the side walls with said front, bottom and rear walls;

a cover sheet forming the top wall of the enclosure and having controls mounted thereon for access from outside the enclosure, said sheet having a rear portion near said rear walls;

a circuit board mounted to the underside of the cover sheet and having a first group of electrical components connected with said controls;

a second group of electrical components mounted on the inside of the base sheet, including a plurality of power receptacles mounted to project through one of the walls thereof;

an electrical cable interconnecting said first and second groups of components and having a length and flexibility sufficient for said cover sheet to be optionally installed with the rear portion thereof near the front wall of the enclosure; and first and second mounting pieces for attaching said cover sheet to the base sheet at top edges thereof.

2. A control unit box, comprising:

a rectangular base sheet of metal, bent to form the front, bottom and rear walls of the box, said rear wall having a greater height than the front wall;

a pair of side walls against opposite edges of said sheet, in contact with opposite edges of said front, bottom and rear walls;

bracket means for connecting each of the side walls with said front, bottom and rear walls;

a rectangular cover sheet of metal forming the top wall of the box and having controls mounted thereon for access from outside the box, said sheet having a rear portion near said rear wall;

a circuit board mounted to the underside of the cover sheet and having a first group of electrical components connected with said controls;

a second group of electrical components mounted on the inside of the base sheet, including a power receptacle mounted to project through the rear wall;

an electrical cable interconnecting said first and second groups of components and having a length permitting said cover sheet to be optionally installed with the rear portion thereof near the front wall of the box; and first and second mounting pieces for attaching said cover sheet to the base sheet at top edges thereof, each of the pieces including a first planar element projecting beneath and against the cover sheet from one of said top edges, a second planar element projecting from the first element at said one top edge to lie inside and against the base sheet, a third planar element projecting from the first and second elements at said one top edge to lie on top of and against the cover sheet, and a fourth planar element projecting from the first and second elements at said one top edge to lie on the outside of and against the base sheet.

3. The control unit box of claim 1, wherein each of said mounting pieces includes:

a first planar element projecting beneath and against the cover sheet from one of said top edges, a second planar element projecting from the first element at said one top edge to lie inside and against the base sheet, a third planar element projecting from the first and second elements at said one top edge to lie on top of and against the cover sheet, and a fourth planar element projecting from the first and second elements at said one top edge to lie on the outside of and against the base sheet.

* * * * *